US005683030A

United States Patent [19]

Moore et al.

[11] Patent Number: 5,683,030

[45] Date of Patent: Nov. 4, 1997

[54] STACKABLE MODULAR CONTAINERS FOR COLLECTING AND SEGREGATING RECYCLABLE MATERIALS

[76] Inventors: Donald J. Moore, 20855 NE. 16th Ave., Suite C24, North Miami Beach, Fla. 33179-2144; Gregory Sierra; Harald Hinsberg, both of 1602 Alton Rd., Suite 431, Miami Beach, Fla. 33139

[21] Appl. No.: 418,248

[22] Filed: Apr. 6, 1995

[51] Int. Cl.[6] ..... B65D 91/00

[52] U.S. Cl. ..... 232/43.1; 220/254; 220/909; 209/706; 312/292; 206/459.5

[58] Field of Search ..... 232/43.1–43.5, 232/44; 220/254, 909, 4.27, 504; 209/630, 702, 703, 706, 930, 928; 206/459.5; 312/107, 111, 263, 292, 328, 204, 211

[56] References Cited

U.S. PATENT DOCUMENTS

| | | | |
|---|---|---|---|
| 3,279,432 | 10/1966 | Forstmaier | 232/43.1 |
| 5,062,539 | 11/1991 | Chandler | 220/909 |
| 5,242,220 | 9/1993 | Sandreth | 220/909 |
| 5,287,980 | 2/1994 | Saltz | 220/4.27 |
| 5,381,916 | 1/1995 | Strawder | 220/909 |
| 5,445,397 | 8/1995 | Evans | 220/909 |

*Primary Examiner*—Flemming Saether
*Attorney, Agent, or Firm*—Robert M. Downey, P.

[57] ABSTRACT

A recycle trash collector for holding and segregating recyclable materials includes a plurality of stackable modular containers having a first door hingedly attached to a front of the containers in covering relation to an open mouth and a second smaller door hingedly attached to the first door in covering relation to a geometrically shaped opening formed in the first door. The first and second doors are structured for swinging movement between open and closed positions. The second door and the corresponding geometrically shaped opening on each container are specifically sized and shaped to identify a particular type of recyclable material and to allow the material to be deposited therein. A plurality of dowel pins extend from the bottom of the containers and a corresponding number of recessed holding ports are located in the top of the containers, the ports being structured to releasably capture the dowel pins therein, thereby enabling the containers to be stacked in secured relation to one another in accordance with a select arrangement.

3 Claims, 2 Drawing Sheets

STACKABLE MODULAR CONTAINERS FOR COLLECTING AND SEGREGATING RECYCLABLE MATERIALS

BACKGROUND OF THE INVENTION

1. Field of the Invention

The present invention relates to recycling containers, and more particularly, to stackable modular recycling containers which include means to identify and hold a particular type of recyclable material therein.

2. Description of the Related Art

In recent years, the focus on the environment has increased dramatically and the importance of recycling has received increased emphasis. In fact, in many areas today, recycling is required by law.

The most common method of collecting and separating recyclable materials is the use of separate bins for each type of recyclable material such as cans, glass, plastic and paper. However, this often requires several bins and utilizes substantial floor space. Further, the bins are open to the surrounding atmosphere, visibly exposing the recycled trash and allowing odors to escape. For this reason, homeowners tend to place them in a concealed area, such as a garage, which may not be a convenient or desirable location. This often results in people forgetting to recycle or simply ignoring the need to recycle because of the inconvenience it presents.

Systems devised to replace the bins have focused on providing a single housing having separate compartments for the different types of recyclable materials. Examples of such systems are shown in U.S. Pat. Nos. 5,192,121 and 5,238,301. However, these devices are large, cumbersome and generally unattractive. Further, the user has no flexibility to tailor the devices to his specific needs. One user may only recycle newspaper. Another may only recycle cans and glass. And yet another may only recycle plastic and newspaper.

Accordingly, in light of the prior art and the differing needs of individual users due to the different recycling laws in different jurisdictions, there is a need in the art for a recycling system which may be tailored to accommodate a specific user's needs, thereby keeping the system as small, simple and attractive as possible. The present invention is designed to fulfill this need by providing a recycle trash collector system which includes individual stackable, modular containers having deposit doors distinctly shaped to identify the particular type of recyclable material to be stored in the particular container; the door and correspondingly shaped opening being sized to allow the particular material to be deposited therein.

SUMMARY OF THE INVENTION

The present invention relates to a recycle trash collector system for holding and segregating recyclable materials. The collector system of the present invention is specifically structured to accommodate an individual users recycling needs and includes a plurality stackable containers so that minimum space is required.

Each of the plurality of stackable, modular containers includes a first trash release door hingedly attached to a front lower edge of the respective container in covering relation to an open mouth, and a second smaller trash deposit door hingedly attached to an outer surface of the first door in covering relation to a congruently shaped deposit opening formed through the first door. The second door and the corresponding deposit opening are specifically sized and shaped to identify a particular type of recyclable material, allowing the material to be deposited therethrough and into the container. The first and second doors include hinge means to allow swinging movement between a closed position and an open position relative to the container. A plurality of dowel pins extend downwardly from the bottom of the containers and a corresponding number of recessed holding ports are integrally formed in the top of the containers. The holding ports are structured to releasably capture the dowel pins in frictional engagement therein, thereby providing the ability to stack the containers in secured relation to one another.

With the foregoing in mind, it is a primary object of the present invention to provide a recycle trash collector system which may be tailored to accommodate an individual user's recycling needs.

It is another object of the present invention to provide a recycle trash collector system which includes stackable, modular containers.

It is a further object of the present invention to provide a recycle trash collector system which includes a small door for depositing the recyclable material and a large door for removing the recyclable material.

It is still a further object of the present invention to provide a recycle trash collector system in which the small door is distinctly sized and shaped to identify a particular type of recyclable material and to allow that material to be deposited therein.

These and other objects and advantages of the present invention will become more readily apparent in the description which follows.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
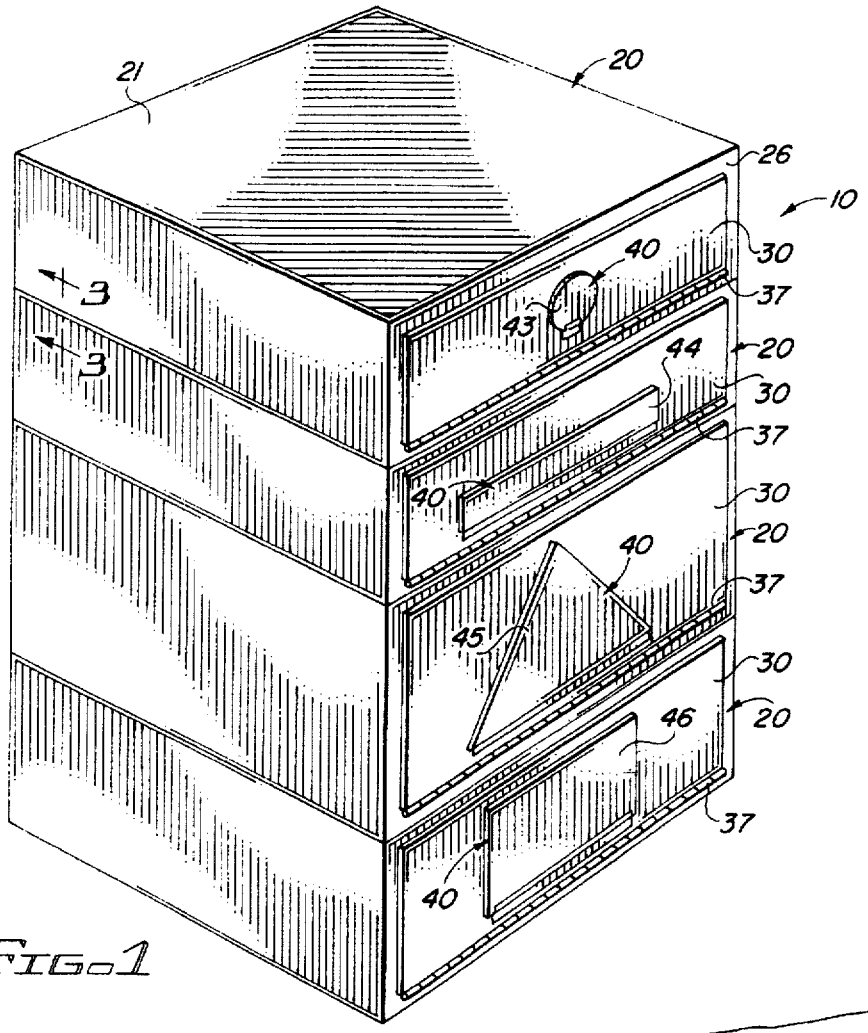
FIG. 1 is a front perspective view of the recycle trash collector system of the present invention.
Figure 2:
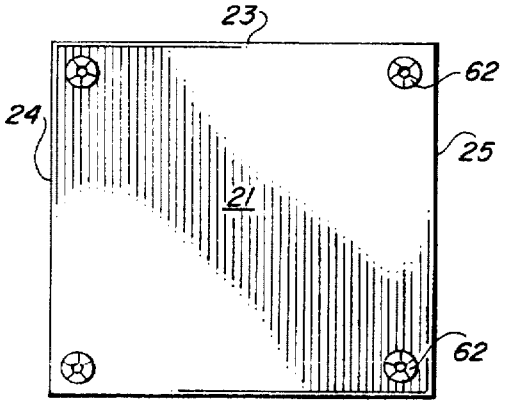
FIG. 2 is a top plan view of the recycle trash collector system showing the holding ports.
Figure 3:
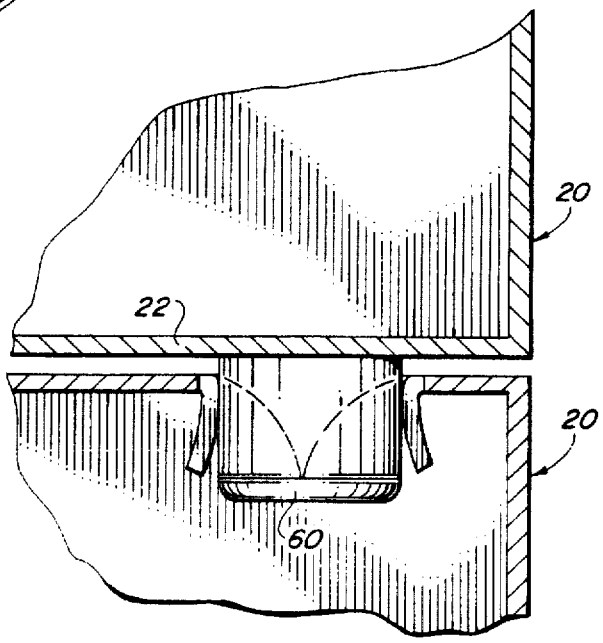
FIG. 3 is a cross-sectional view, in partial section, taken along the plane of the line 3—3 in FIG. 1 showing the dowel pin captured within the holding port.
Figure 4:
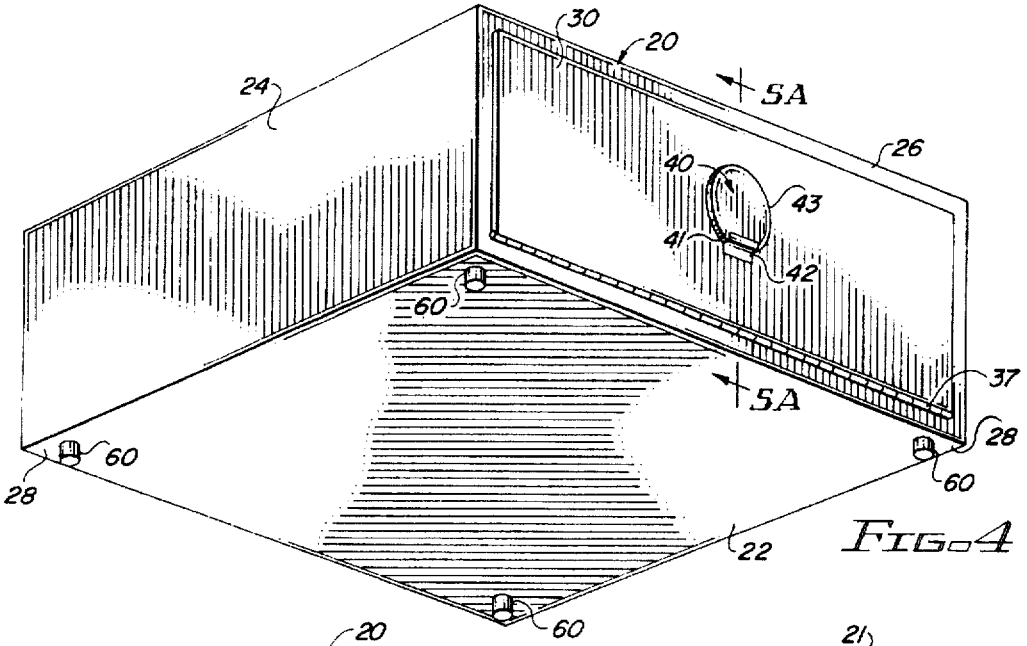
FIG. 4 is a front perspective view of the modular container showing the distinctly shaped second door and the dowel pins.
Figure 5A:
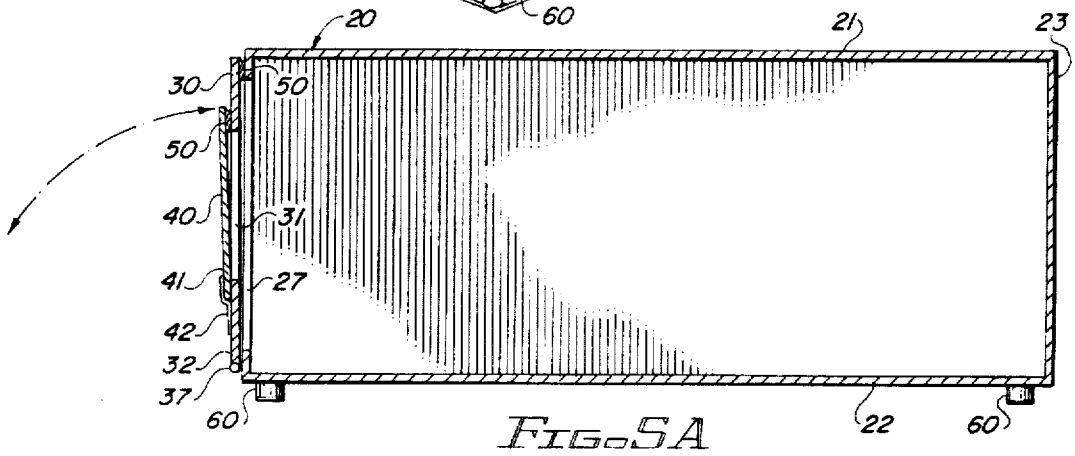
FIG. 5A is a side elevation of the modular container, in cross-sectional view, taken along the plane of the line 5A—5A of FIG. 4 showing the first and second doors in a closed position.
Figure 5B:
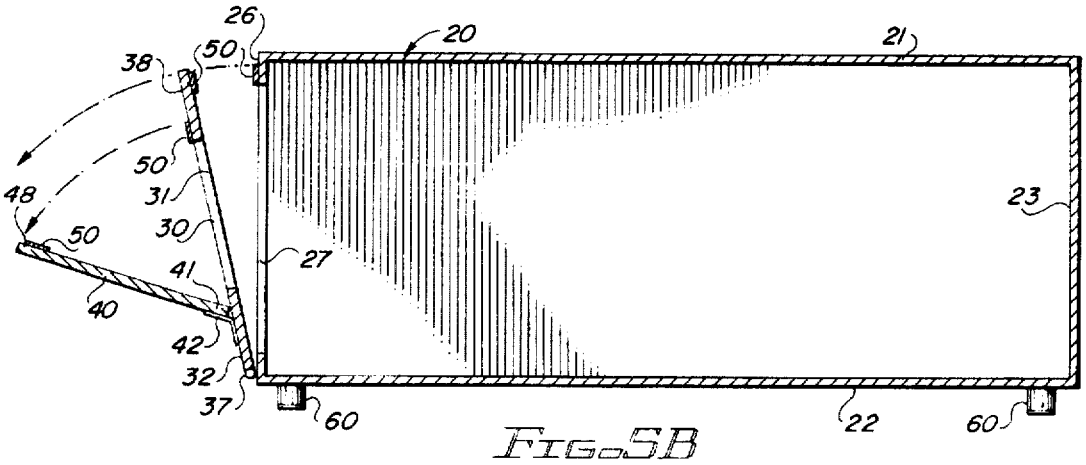
FIG. 5B is the cross-sectional view of the modular container shown in FIG. 5A showing the first and second doors in a partially open position.

With reference to FIGS. 1–5B, the present invention is directed to a recycle trash collector system, generally indicated as 10, for holding and segregating recyclable materials. The recycle trash collector system 10 includes a plurality of stackable, modular containers 20, each structured to receive and store a particular recyclable material therein. Each container 20 includes a top 21, a bottom 22, a rear wall 23, opposite side walls 24 and 25 and a front 26 having an open mouth 27 therein in communication with a hollow interior storage chamber. The storage chamber is structured and configured to contain a particular type of the recyclable materials therein. The open mouth 27 is structured to permit removal of the particular type of the recyclable materials from the interior storage chamber.

A first door 30, having a geometrically shaped opening 31 integrally formed therein, is attached by a hinge 37 along its lower edge 32, to the front 26 of the containers 20 in covering relation to the open mouth 27. The hinge 37 controls the opening and closing of the first door 30 and is structured to provide the first door 30 with swinging movement between a first vertical, closed position and a second horizontal, open position. The geometrically shaped opening 31 is selectively sized and shaped to identify the particular type of recyclable material and to allow that particular type of material to be deposited into the container 20. Having different geometrically shaped openings 31 serves to distinguish each container 20 and the particular type of recyclable material stored therein from one another.

A second smaller door 40 is attached along its lower edge 41 to the first door 30 by a flexible tape 42 in covering relation to the geometrically shaped opening 31. The second door 40 is sized and shaped congruently with the corresponding geometrically shaped opening 31. The tape 42 is structured to provide the second door 40 with swinging movement between a first closed position and a second open position to permit the particular type of the recyclable materials to be deposited into the interior storage chamber through the opening 31. The second door 40, being smaller than the first door 30, helps to prevent materials within the containers 20 from spilling out each time additional recyclable materials are deposited through the opening 31.

A circular shaped second door 43 and opening 33 is used for depositing recyclable cans. A narrow rectangular shaped second door 44 and opening 34 is used for depositing recyclable newspaper. A triangular shaped second door 45 and opening 35 is used for depositing recyclable glass bottles and jars. A square shaped second door 46 and opening 36 is used for depositing recyclable plastic materials.

Latching means 50, such as hook and loop fasteners, is used to secure the first 30 and second 40 doors in the closed position. For securing the first door 30, a first strip of hook and loop fastening material is mounted along the upper end zone 38 of the inside surface of the first door 30 and a second mating strip of hook and loop material is mounted along the front 26 of the containers 20 so that the first and second strips of hook and loop fasteners are aligned when the first door 30 is the closed position. For securing the second door 40, a third strip of hook and loop fastening material is mounted along the upper end zone 48 of the inside surface of the second door 40 and a fourth mating strip of hook and loop material is mounted along the outside surface of the first door 30 so that the third and fourth strips of hook and loop fasteners are aligned when the second door 40 is in the closed position. Alternatively, the latching means 50 may include magnets or other known means for releasable attachment.

A plurality of dowel pins 60 extend outward from the bottom 22 of each container 20 in perpendicular relation to the bottom 22. A dowel pin 60 is located near each corner 28 of the bottom 22.

A plurality of recessed holding ports 62, equal to the number of dowel pins 60 in each container 20, are integrally formed in the top 21 of each container 20. The ports 62 are structured to releasably capture the dowel pins 60 therein. The ports 62 and dowel pins 60 are aligned so that the rear wall 23, opposite side walls 24 and 25 and front 26 of each container 20 are aligned when the containers 20 are stacked with the dowel pins 60 captured within the ports 62.

Various changes may be made within the spirit and scope of the invention as described above and set forth in the accompanying claims. The size and shape of the containers, as well as the second door and the corresponding covered opening may be modified. Further, the number of containers used may vary to accommodate the particular recycling needs of each user.

What is claimed is:

1. A recycle trash collector system for holding and segregating recyclable materials comprising:

a plurality of modular containers each including a top, a bottom, a rear wall, opposite side walls, and a front having an open mouth therein in communication with a hollow interior storage chamber, each of said containers being structured and configured to contain a particular type of the recyclable materials within said storage chamber thereof, said open mouth being structured and configured to permit removal of the particular type of the recyclable materials from said interior storage chamber, a first door hingedly attached to said front of each of said containers in covering relation to said open mouth to provide access for removal of the particular type of the recyclable materials from said interior storage chamber, each of said first doors of said containers including a geometrically shaped opening integrally formed therein and being sized to allow the particular type of recyclable materials to be deposited therethrough and into said interior storage chamber, a plurality of second deposit doors each of a different geometrical shape and being smaller than said first door, said plurality of second deposit doors each being hingedly attached to a respective one of said plurality of containers on said first door and in covering relation to said geometrically shaped opening, each of said different geometrically shaped second deposit doors corresponding with and identifying the particular type of the recyclable materials to be deposited within the respective one of said plurality of containers to which each of said second deposit doors is attached, said first and said second doors being structured for swinging movement between a first vertical, closed position and a second open position, latching means for securing said first and said second doors in said first closed position, and stacking means for vertically stacking said plurality of containers in a removable, secured relation to one another.

2. A recycle trash collector system as recited in claim 1 wherein said latching means includes hook and loop means for releasably securing said first door in said first closed position and for releasably securing said second door in said first closed position.

3. A recycle trash collector system as recited in claim 1 wherein said stacking means includes at least one dowel pin extending outward from said bottom of said containers and at least one recessed holding port in said top of said containers, said at least one holding port being structured and disposed to releasably capture said at least one dowel pin therein, thereby providing the ability to stack said containers in removable, secured relation to one another.

* * * * *